US005431740A

United States Patent [19]

Swain

[11] Patent Number: 5,431,740

[45] Date of Patent: Jul. 11, 1995

[54] CARBON DIOXIDE PRECISION CLEANING SYSTEM FOR CYLINDRICAL SUBSTRATES

[75] Inventor: Eugene A. Swain, Webster, N.Y.

[73] Assignee: Xerox Corporation, Stamford, Conn.

[21] Appl. No.: 161,072

[22] Filed: Dec. 3, 1993

Related U.S. Application Data

[63] Continuation of Ser. No. 815,472, Dec. 31, 1991, abandoned.

[51] Int. Cl.[6] ..... B08B 7/00

[52] U.S. Cl. ..... 134/7; 134/34; 451/53; 451/7

[58] Field of Search ..... 134/7, 34, 93

[56] References Cited

U.S. PATENT DOCUMENTS

| | | | |
|---|---|---|---|
| 4,617,064 | 10/1986 | Moore | 134/11 |
| 5,108,512 | 4/1992 | Goffnett et al. | 134/7 |
| 5,125,979 | 6/1992 | Swain et al. | 134/7 |
| 5,147,466 | 9/1992 | Ohmori et al. | 134/7 |
| 5,226,969 | 7/1993 | Watanabe et al. . | |

*Primary Examiner*—Anthony McFarlane
*Attorney, Agent, or Firm*—Kenyon & Kenyon

[57] ABSTRACT

An apparatus for cleaning cylindrical surfaces includes a plurality of cleaning stations. Each cleaning station is designed to receive a substrate and includes a plurality of nozzles. The inlet end of each nozzle is connected to a source of liquid Carbon Dioxide, and the outlet end of each nozzle is connected to one end of a respective Carbon Dioxide expansion chamber. Liquid Carbon dioxide leaving each nozzle is converted to solid Carbon Dioxide in the corresponding expansion chamber. The other end of each Carbon Dioxide expansion chamber is coupled to a respective funnel which is, in turn, connected to a dispersing saddle. The dispersing saddles disperse the stream of solid Carbon Dioxide particles leaving each funnel and direct these particles to the substrate surface. The dispersing saddles are placed such that the entire circumference of the substrate surface is enveloped within the various streams of solid Carbon Dioxide particles. In addition, the apparatus may include a source of a dry nonreactive gas which is introduced into each stream of solid Carbon Dioxide particles in order to reduce condensation on the surface from the surface of the substrate and to further direct each stream of solid Carbon Dioxide particles to the substrate surface.

10 Claims, 4 Drawing Sheets

CARBON DIOXIDE PRECISION CLEANING SYSTEM FOR CYLINDRICAL SUBSTRATES

This application is a continuation of application Ser. No. 07/815,472 filed on Dec. 31, 1991, now abandoned.

BACKGROUND OF THE INVENTION

This invention relates to an apparatus and method for cleaning the outer surfaces of cylindrical substrates and relates, in particular, to an apparatus and method for precision cleaning the outer surfaces of cylindrical substrates for electrostatographic imaging members.

Various techniques have been devised to clean debris such as submicron particles from substrate surfaces. The semiconductor industry has employed high pressure liquids alone or in combination with fine bristled brushes to remove finely particulate contaminants from semiconductor wafers. These processes have achieved some success in removing contaminants, but the brushes scratch the substrate surface and the high pressure liquids tend to erode the delicate surfaces and can even generate an undesirable electric discharge. Also the liquid can not readily be collected after use in brush and high pressure liquid systems.

An improved cleaning system has been discovered in which a mixture of substantially pure solid and gaseous Carbon Dioxide removes submicron particles from substrate surfaces without the disadvantages associated with the above-described brush and high pressure liquid systems. Pure Carbon Dioxide (99.99+%) is expanded from the liquid state to produce dry ice snow which can is blown across a surface to remove submicron particles without scratching the substrate surface. The Carbon Dioxide snow vaporizes when exposed to ambient temperatures leaving no residue and thereby eliminating the problem of fluid collection.

More recently, apparatus for making Carbon Dioxide snow and for directing a solid/gas mixture of Carbon Dioxide to a substrate is described in Hoenig, Stuart A., "Cleaning Surfaces with Dry Ice" (Compressed Air Magazine, August, 1986, pp. 22–25). By means of this device, liquid Carbon Dioxide is depressurized through a long cylindrical tube of uniform diameter to produce a solid/gas Carbon Dioxide mixture which is then directed to the substrate surface. A concentrically positioned tube is used to add a flow of dry Nitrogen gas to thereby prevent the build-up of condensation.

Despite being able to remove some submicron particles, the aforementioned device suffers from several disadvantages. For example, the cleaning effect is limited primarily due to the low gas velocity and the flaky and fluffy nature of the solid Carbon Dioxide. In addition, the geometry of the long cylindrical tube makes it difficult to control the Carbon Dioxide feed rate and the rate and angle at which the snow stream contacts the substrate surface.

In U.S. Pat. No. 4,806,171 to Whitlock et al., an orifice is used to provide a pathway for the flow of fluid Carbon Dioxide into a coalescing chamber where the fine liquid droplets first form and then coalesce into large liquid droplets which are the precursor of the minute solid particles of Carbon Dioxide which are not normally resolvable by the human eye. The large droplets are formed into solid particles as the feed passes from the coalescing chamber through a second orifice and out of the exit port toward a substrate surface. In the disclosed system, a nozzle is inserted into a hollow cylindrical structure to be cleaned, fluid Carbon Dioxide is supplied to the nozzle, and the nozzle is slowly withdrawn from the structure. An umbrella-shaped jet formed by the nozzle sweeps the interior surface of the cylindrical structure and the vaporized Carbon Dioxide carries released surface particles along as it exits the tube in front of the advancing jet. This technique utilizes a moving nozzle that requires complex apparatus including, for example, flexible hoses, special flexible couplings, and precision alignment devices. Moreover, some of the debris removed by the jet can leak toward the previously cleaned interior surface of the cylindrical structure and redeposit on the previously cleaned interior surface.

When Carbon Dioxide particle cleaning techniques are utilized to clean the exterior of cylinders, it is often difficult to achieve clean exterior surfaces because dirt particles removed by the Carbon Dioxide particles tend to remain suspended in the air and are subsequently redeposited on the surfaces of cylinders that were previously cleaned. Moreover, as extruded Carbon Dioxide pellets are inherently large, delicate surfaces are often damaged.

Thus there is a need for a cylindrical substrate cleaning system which is of relatively simple design and which can accommodate more smaller diameter substrates in a closer spatial relationship.

SUMMARY OF THE INVENTION

The present invention reduces the above-noted deficiencies by providing an apparatus for cleaning cylindrical surfaces which comprises a source of liquid Carbon Dioxide, and a plurality of nozzles, each nozzle being connected to the source of liquid Carbon Dioxide at an inlet end. A plurality of Carbon Dioxide expansion chambers for converting the liquid Carbon Dioxide to solid Carbon Dioxide is provided, each Carbon Dioxide expansion chamber being coupled to an outlet end of a respective nozzle. Means are provided for dispersing the stream of solid Carbon Dioxide particles exiting each Carbon Dioxide expansion chamber across the surface to be cleaned. In addition, a dry nonreactive gas may be directed into each dispersed stream of solid Carbon Dioxide particles to reduce condensation on the surface to be cleaned and to further direct the stream of solid Carbon Dioxide particles to impact the surface.

The apparatus may include a plurality of cleaning stations, each cleaning station accommodating one substrate and including a plurality of nozzles, wherein each nozzle is connected to the source of liquid Carbon Dioxide at an inlet end. A plurality of Carbon Dioxide expansion chambers for converting the liquid Carbon Dioxide to solid Carbon Dioxide, are provided, one end of each Carbon Dioxide expansion chamber being coupled to an outlet end of a respective nozzle and the other end being coupled to means for dispersing a stream of solid Carbon Dioxide particles exiting each Carbon Dioxide expansion chamber across the surface of the substrate to be cleaned. Finally, means are provided for moving each of the plurality of substrates through a respective cleaning station for cleaning therein.

BRIEF DESCRIPTION OF THE DRAWINGS

A more complete understanding of the process and apparatus of the present invention can be obtained by reference to the accompanying drawings wherein.

DESCRIPTION OF THE PREFERRED EMBODIMENTS

Figure 1:
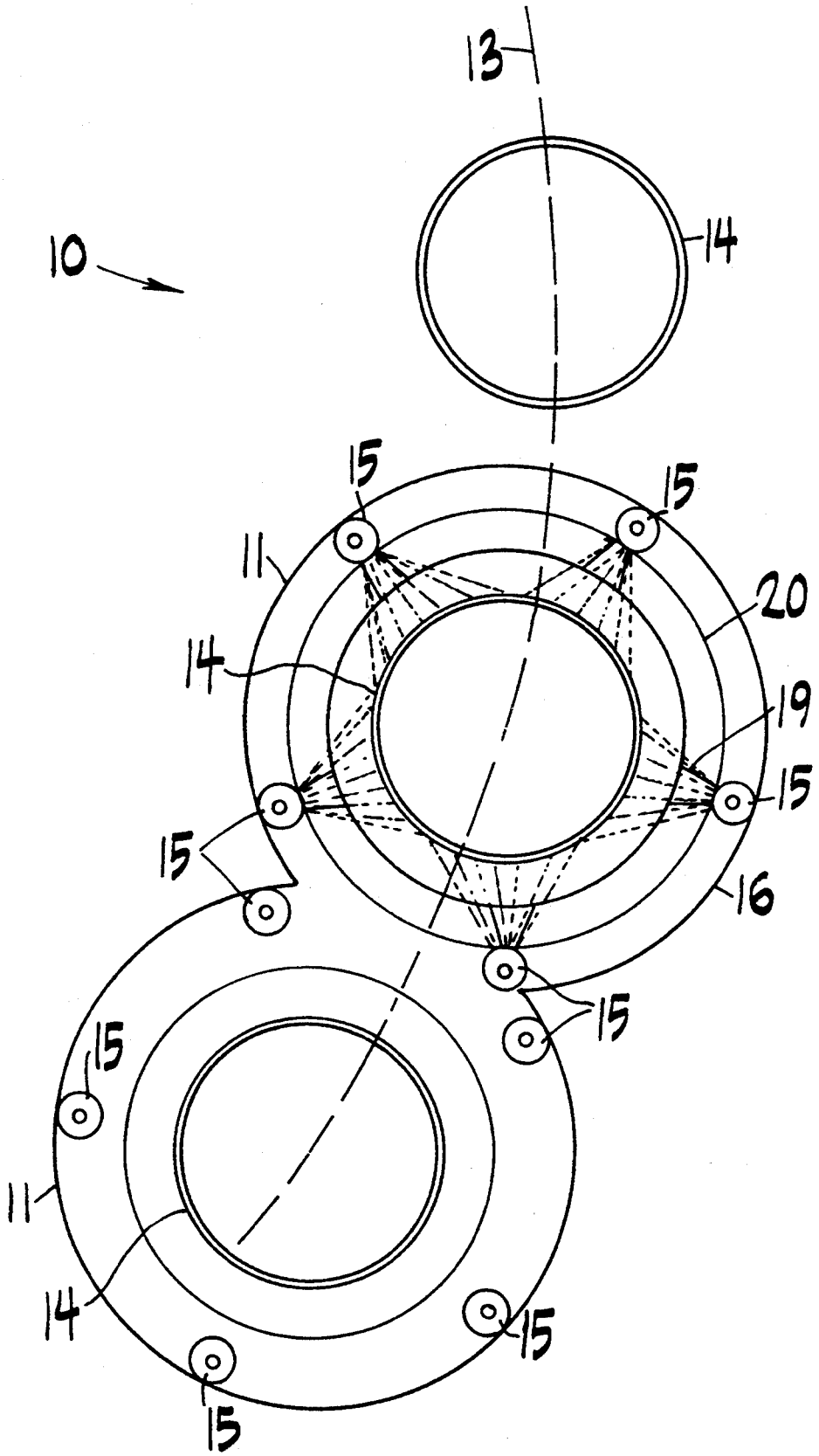
FIG. 1 is a schematic, sectional view in elevation showing cleaning apparatus with a plurality of nozzles.
Figure 2:
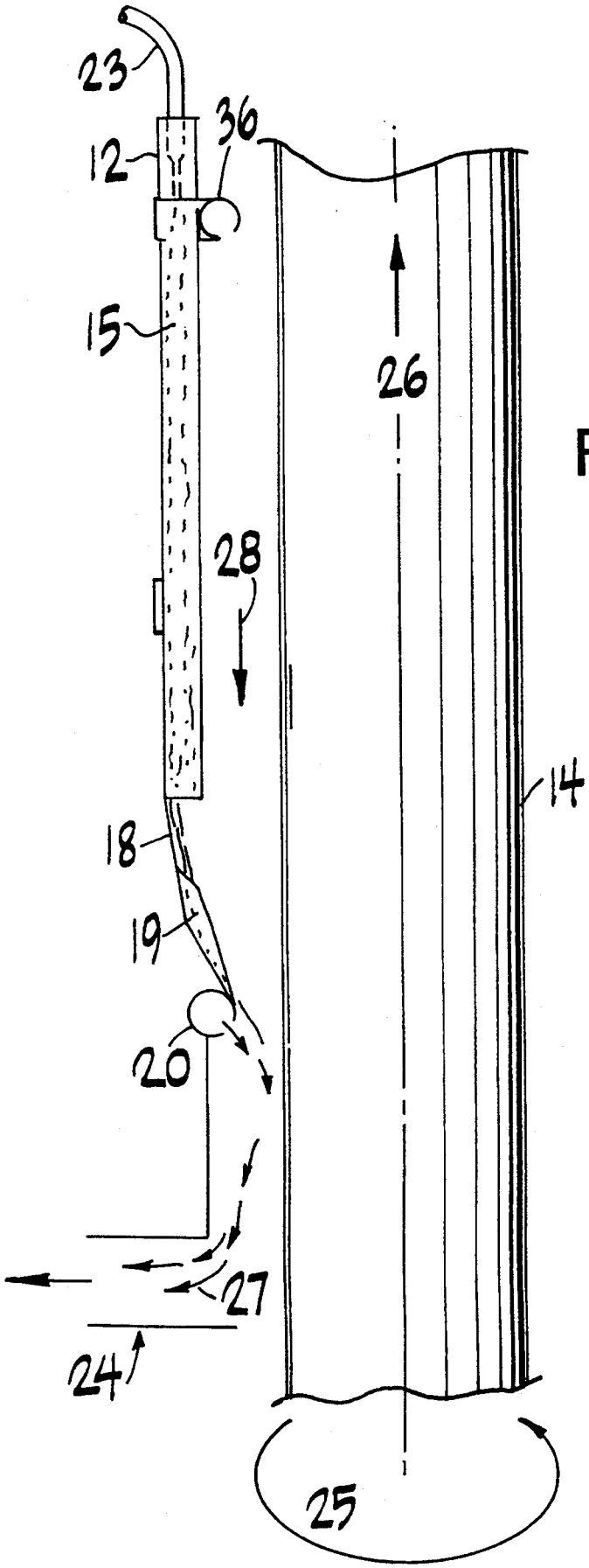
FIG. 2 is a schematic, expanded sectional view of the cleaning apparatus illustrated in FIG. 1.
Figure 4:
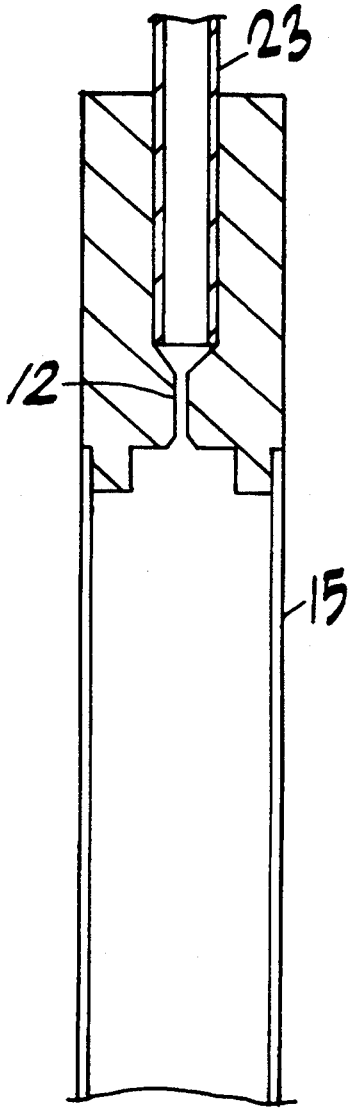
FIG. 4 is a cross-sectional view of a Carbon Dioxide nozzle and tube according to the present invention.

Illustrated in FIG. 1, 2, and 4, is an apparatus 10 for cleaning substrates. The apparatus 10 may be employed in an automated substrate manufacturing system as disclosed in U.S. Pat. No. 5,038,707, to Swain et al., which is expressly incorporated by reference herein as part of the present disclosure.

Figure 3:
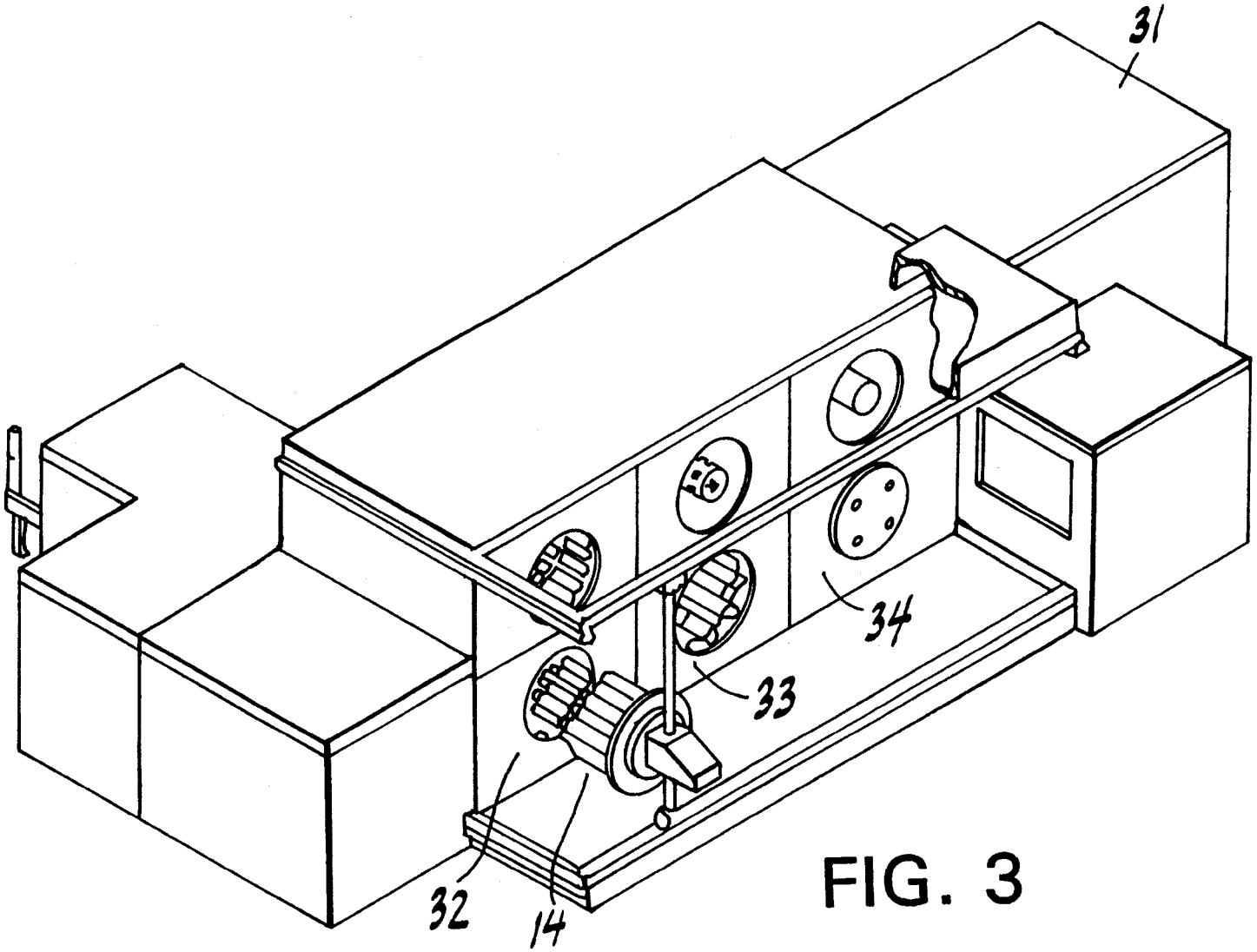
FIG. 3 shows a substrate manufacturing apparatus employing the cleaning apparatus of the present invention.

As shown in FIG. 3, an automated substrate manufacturing apparatus is indicated generally by the numeral 31. The apparatus 31 includes various processing modules, in each of which a separate processing function is performed. A precision cleaning module 33, is located adjacent to a loading module 32 and a rotary coating module 34. Substrates are loaded into the apparatus 31 via the loading module 32 from which they are moved to the precision cleaning module 33. According to the apparatus disclosed in U.S. Pat. No. 5,038,707, 20 substrates are disposed around a substrate circle 13, 17 inches in diameter, within the precision cleaning module 33. The precision cleaning module 33 includes a cleaning apparatus which includes 20 cleaning stations each located about the circumference of the substrate circle 13 to receive a respective substrate.

As shown in FIGS. 2 and 4, this apparatus 10 moves each of a plurality of cylindrical substrates 14 through a respective cleaning station 16 in the precision cleaning module 33. Those skilled in the art will recognize that the cleaning stations may also be moved over stationary substrates to achieve the desired surface cleaning. The cleaning stations 16 are preferably distributed equally spaced about a substrate circle 13. Each cleaning station 16 of apparatus 10 is mounted on the inner surface of housing 11 and preferably includes 5 Carbon Dioxide nozzles 12 which are distributed about a cylindrical substrate 14 which is positioned for cleaning. Each Carbon Dioxide nozzle 12 is connected at an inlet end to a source of liquid Carbon Dioxide (not shown) via respective supply line 23 which may preferably be stainless steel tubing. The outlet end of the nozzle 12 is preferably approximately 2/100 of an inch in diameter and is mounted within the inlet end of a tube 15 of non-reactive material, preferably teflon. The outlet end of each tube 15 is coupled to one end of a double angle impingement funnel 18 and a respective dispersing saddle 19 is coupled to the other end of each funnel 18. The dispersing saddles 19 are preferably placed such that the resulting Carbon Dioxide streams are separated by equal angles about a circle through which the substrate 14 will pass. In addition, the dispersing saddles 19 are preferably placed such that the entire circumference of each substrate is enveloped in the streams of Carbon Dioxide.

A nozzle 20 which is connected to a source of dry, nonreactive gas (not shown), which is preferably Nitrogen gas, is located adjacent to each dispersing saddle 19. This dry, nonreactive gas provided to each stream of Carbon Dioxide reduces condensation and aids in directing the impact of the carbon dioxide particles against the surface of the substrate 14. This allows the cleaning apparatus to supply solid Carbon Dioxide particles to the surface with increased velocity and to direct these particles to the surface more directly, while reducing the volume of the apparatus. This is possible because, although the tubes 15 are arranged substantially parallel to the substrates 14 in order to minimize the space required between the substrates 14, the double angle impingement funnels 18 and the dispersing saddles 19 redirect the stream of solid Carbon Dioxide particles toward the surface at an angle which is preferably less than 45 degrees relative to the tube 15, and is more preferably between 15 and 35 degrees. This reduced angle allows the solid Carbon Dioxide particles to retain a significant portion of their velocity upon leaving the tube 15. After leaving the end of the dispersing saddle 19, the streams are directed to the surface at a steeper angle by the streams of dry, nonreactive gas leaving the nozzle 20. This allows the system of the present invention to achieve an effective angle of impact of solid Carbon Dioxide particles with the surface to be cleaned, with minimal loss of particle velocity, while reducing the space required for the cleaning apparatus.

In addition, a second nozzle 36 which is connected to a source of dry, nonreactive gas, is mounted to the inlet end of each of the tubes 15 and positioned such that a stream of the dry, nonreactive gas is directed along the surface of the cylinder toward the outlet end of tubes 15 in the direction of arrow 28. This second stream of dry, nonreactive gas leaves the nozzle 36 at a velocity which is relatively low in comparison to the velocity of the solid Carbon Dioxide particles. This stream of dry, nonreactive gas is primarily employed to reduce condensation and to provide an inert atmosphere in the cleaning area. The relatively low velocity of this stream insures that the dry nonreactive gas does not reduce the cleaning action of the solid Carbon Dioxide particles. The dry, nonreactive gas and the Carbon Dioxide particles are removed from the surface via exhaust channel 24 in the direction of arrow 27.

In operation, the substrate manufacturing apparatus 31 moves the substrates 14 axially, in the direction of arrow 26, and rotates the substrates in the direction of arrow 25, through the cleaning stations 16. This rotation may be between 20 and 120 rpm, and is preferably between 40 and 80 rpm, but is more preferably approximately 60 rpm. For the system according to the disclosed embodiment of the present invention, when the substrate is moved axially through the cleaning stations 16 at a slow rate cleaning is more effective. However, as this speed decreases there is an attendant increase in the quantity of Carbon Dioxide required to clean each substrate. The axial speeds of the substrates 14 through the cleaning stations 16 may be between 0 and about 4 inches per second, and is preferably between 1 and about 3 inches per second, but is more preferably about 2 inches per second.

Liquid Carbon Dioxide is supplied to the nozzle 12 where it is released into the tube 15. As the Carbon Dioxide travels through the tube 15, it expands and solidifies. The tube 15 may be from $\frac{1}{8}$ of an inch to $\frac{3}{4}$ of an inch in diameter, and is preferably between 3/16 of an inch and $\frac{1}{2}$ in diameter, and is more preferably about $\frac{1}{4}$ of an inch in diameter and may be from 1 to 6 inches in length, and is more preferably approximately $2\frac{1}{2}$ inches in length between the outlet end of the nozzle and the outlet end of the tube 15. As is known in the art, the size of the resulting solid Carbon Dioxide particles may be controlled by varying the length of the tube 15. As the solid Carbon Dioxide particles are directed by the funnel 18 to the dispersing saddle 19, the solid Carbon Dioxide particles are spread over a fan shaped area and are directed to the surface of the substrate. A nozzle 20 which is connected to a source of inert gas, preferably Nitrogen, is located adjacent to each dispersing saddle 19. Each nozzle 20 directs a stream of dry, nonreactive gas along the surface to be cleaned such that the stream of particles leaving the dispersing saddle 19 impacts the surface more directly. Those skilled in the art will recognize that these dimensions may be varied over a wide range. However, as the diameter of the tube 15 is increased the velocity of the solid Carbon Dioxide particles is decreased. As is known in the art, a desired velocity may be maintained with an increased diameter tube 15 by increasing the nozzle outlet diameter accordingly.

Each of the nozzles 20 and 36 is preferably in the form of a slot formed in an annular chamber which is disposed such that it encircles the substrate 14 while it is in the cleaning station 16. In this embodiment of the present invention 5 nozzles 12 and 2 nozzles 20 per cleaning station are used to clean the entire circumference of the substrates 14.

Those skilled in the art will recognize that by varying the dimensions of the fan shaped area, i.e. by altering the contour of the dispersing saddles 19 and the volume and velocity of the Carbon Dioxide leaving the tubes 15, the number of nozzles 12 per cleaning station 16 may be varied. The number of nozzles 12 per cleaning station 16 may be further varied by altering the rates at which the substrates 14 are moved through, and rotated in, the cleaning stations 16.

There are various changes and modifications which may be made to the embodiment described as would be apparent to those skilled in the art. However, these changes and modifications are included in the teaching of the disclosure, and it is intended that the invention be limited only by the scope of the claims appended hereto.

What is claimed is:

1. A method for cleaning a substrate comprising the steps of:

placing the substrate in a cleaning station comprising at least one expansion chamber having an outlet;

expanding liquid Carbon Dioxide within the expansion chamber from a source of Carbon Dioxide to generate particles of solid Carbon Dioxide;

directing a stream of the solid Carbon Dioxide particles to the outlet such that the stream of solid Carbon Dioxide particles leaves the outlet at a first angle relative to the expansion chamber; and redirecting the stream toward the substrate at a second angle greater than the first angle so that the stream contacts and cleans the surface of the substrate.

2. A method according to claim 1, further comprising the step of rotating the substrate as it is moved through the cleaning station.

3. A method according to claim 1, wherein a stream of dry nonreactive gas is directed toward the stream of solid Carbon Dioxide particles to redirect the stream of solid Carbon Dioxide toward the substrate and wherein the dry nonreactive gas is Nitrogen.

4. A method according to claim 1, wherein the stream of solid Carbon Dioxide particles is directed to the surface of the substrate from at least 5 outlets.

5. A method according to claim 1, wherein the outlets are positioned such that the stream of solid Carbon Dioxide particles leaving the outlets envelops the entire surface of the substrate to be cleaned.

6. A method according to claim 1, wherein each of the steps is performed substantially simultaneously at each of a plurality of locations on a respective plurality of substrates.

7. The method of claim 1 wherein the stream of solid Carbon Dioxide particles is redirected to the second angle by contacting an angled surface.

8. The method of claim 1 wherein after being redirected to the second angle, the stream of solid Carbon Dioxide particles is again redirected toward the substrate at a third angle greater than the first and second angles.

9. The method of claim 1 wherein the stream of solid Carbon Dioxide particles is redirected to the second angle by subjecting the stream of solid particles to a stream of gas.

10. The method of claim 8, wherein the stream of solid Carbon Dioxide particles is redirected to the second angle by subjecting the stream of solid particles to a stream of gas.

* * * * *